US010957475B2

(12) United States Patent
Kwon et al.

(10) Patent No.: US 10,957,475 B2
(45) Date of Patent: Mar. 23, 2021

(54) COIL COMPONENT

(71) Applicant: SAMSUNG ELECTRO-MECHANICS CO., LTD., Suwon-si (KR)

(72) Inventors: Soon Kwang Kwon, Suwon-si (KR); Young Seuck Yoo, Suwon-si (KR); Jung Wook Seo, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 315 days.

(21) Appl. No.: 15/806,089

(22) Filed: Nov. 7, 2017

(65) Prior Publication Data

US 2018/0190422 A1 Jul. 5, 2018

(30) Foreign Application Priority Data

Jan. 2, 2017 (KR) ..... 10-2017-0000439

(51) Int. Cl.

| | |
|---|---|
| ***H01F 27/255*** | (2006.01) |
| ***H01F 27/28*** | (2006.01) |
| ***H01F 41/071*** | (2016.01) |
| ***H01F 41/02*** | (2006.01) |
| *H01F 17/04* | (2006.01) |

(52) U.S. Cl.

CPC ..... *H01F 27/255* (2013.01); *H01F 27/2823* (2013.01); *H01F 41/0246* (2013.01); *H01F 41/071* (2016.01); *H01F 2017/048* (2013.01)

(58) Field of Classification Search

CPC ..... H01F 27/255; H01F 27/2823; H01F 2017/048; H01F 17/0013; H01F 17/0033; H01F 27/292

USPC ..... 336/200, 232

See application file for complete search history.

(56) References Cited

U.S. PATENT DOCUMENTS

| | | | | |
|---|---|---|---|---|
| 6,392,525 | B1 * | 5/2002 | Kato | H01F 3/08 336/200 |
| 6,452,473 | B1 * | 9/2002 | Suzuki | H01F 17/0013 336/200 |
| 6,483,409 | B1 * | 11/2002 | Shikama | H01F 17/045 336/212 |
| 6,506,264 | B1 * | 1/2003 | Hisano | B22F 1/0011 148/301 |

(Continued)

FOREIGN PATENT DOCUMENTS

| | | | | |
|---|---|---|---|---|
| JP | 2002105502 A | * | 4/2002 | H01F 1/24 |
| JP | 2009-009985 A | | 1/2009 | |

(Continued)

*Primary Examiner* — Tszfung J Chan

(74) *Attorney, Agent, or Firm* — Morgan, Lewis & Bockius LLP

(57) ABSTRACT

A hybrid coil component in which a magnetic core generally included in a wire-wound type inductor and a core included in a multilayer type inductor are combined with each other. A winding coil may be wound around a magnetic core manufactured in advance and an encapsulant having a stacked structure of a plurality of magnetic sheets may encapsulate the winding coil wound around the magnetic core. In this case, a magnetic flux generated in the winding coil is arranged to be parallel to long axes of magnetic particles contained in the magnetic core and the encapsulant.

19 Claims, 10 Drawing Sheets

(56) References Cited

U.S. PATENT DOCUMENTS

| | | | | |
|---|---|---|---|---|
| 7,973,630 | B2 * | 7/2011 | Masai | H01F 17/0006 257/275 |
| 2009/0002117 | A1 * | 1/2009 | Kawarai | H01F 17/0006 336/233 |
| 2012/0274437 | A1 * | 11/2012 | Matsuura | H01F 27/24 336/221 |
| 2013/0020913 | A1 * | 1/2013 | Shirakawa | H01G 4/30 310/364 |
| 2013/0120905 | A1 * | 5/2013 | Son | H01F 17/0033 361/321.2 |
| 2014/0167897 | A1 | 6/2014 | Choi et al. | |

FOREIGN PATENT DOCUMENTS

| | | | | | |
|---|---|---|---|---|---|
| JP | 2009009985 | A | * | 1/2009 | H01F 17/0006 |
| KR | 10-1999-0066108 | A | | 8/1999 | |
| KR | 10-2014-0077346 | A | | 6/2014 | |

* cited by examiner

COIL COMPONENT

CROSS-REFERENCE TO RELATED APPLICATION(S)

This application claims benefit of priority to Korean Patent Application No. 10-2017-0000439 filed on Jan. 2, 2017 in the Korean Intellectual Property Office, the disclosure of which is incorporated herein by reference in its entirety.

BACKGROUND

1. Field

The present disclosure relates to a coil component, and more particularly, to a hybrid power inductor in which a molding inductor and a multilayer inductor are coupled to each other.

2. Description of Related Art

In general, since particles of a ferrite or metal powder used as a magnetic material in an inductor have a shape close to spherical, when a magnetic field is applied, the magnetic field is equally distributed in all directions rather than in a specific direction. Here, in a case of using a plate-shaped magnetic powder flake of which a long axis and a short axis have different lengths from each other, since a distance of the short axis is shorter than a distance of the long axis, the plate-shaped magnetic powder flake is easily magnetized along its long axis rather than its short axis. In a case of using a magnetic sheet containing the plate-shaped magnetic powder flake having shape-related magnetic anisotropy as described above, an inductor having high permeability may be manufactured.

Korean Patent Laid-Open Publication No. 10-2014-0077346 provides a method of disposing a plate-shaped sheet formed of metal powder in upper and lower cover parts in order to secure high permeability by stacking magnetic sheets containing the plate-shaped powder flake as described above. However, while a plurality of sheets are being stacked, a coil embedded therein may be deformed.

SUMMARY

An aspect of the present disclosure may provide a coil component having improved reliability by preventing a coil from being deformed, and having high permeability.

According to an aspect of the present disclosure, a coil component may include: a body including a winding coil; and external electrodes disposed on an external surface of the body. The body may include a magnetic core wound with the winding coil, and an encapsulant encapsulating the winding coil, wherein the magnetic core and the encapsulant may contain first and second magnetic particles having shape-related magnetic anisotropy, respectively. In addition, the encapsulant may have a stacked structure in which a plurality of magnetic sheets containing the second magnetic particle are stacked. Long axes of the first and second magnetic particles may be arranged to be parallel to a direction of a magnetic field formed in the winding coil.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Hereinafter, a coil component according to an exemplary embodiment in the present disclosure will be described, but is not necessarily limited thereto.

Figure 1A:
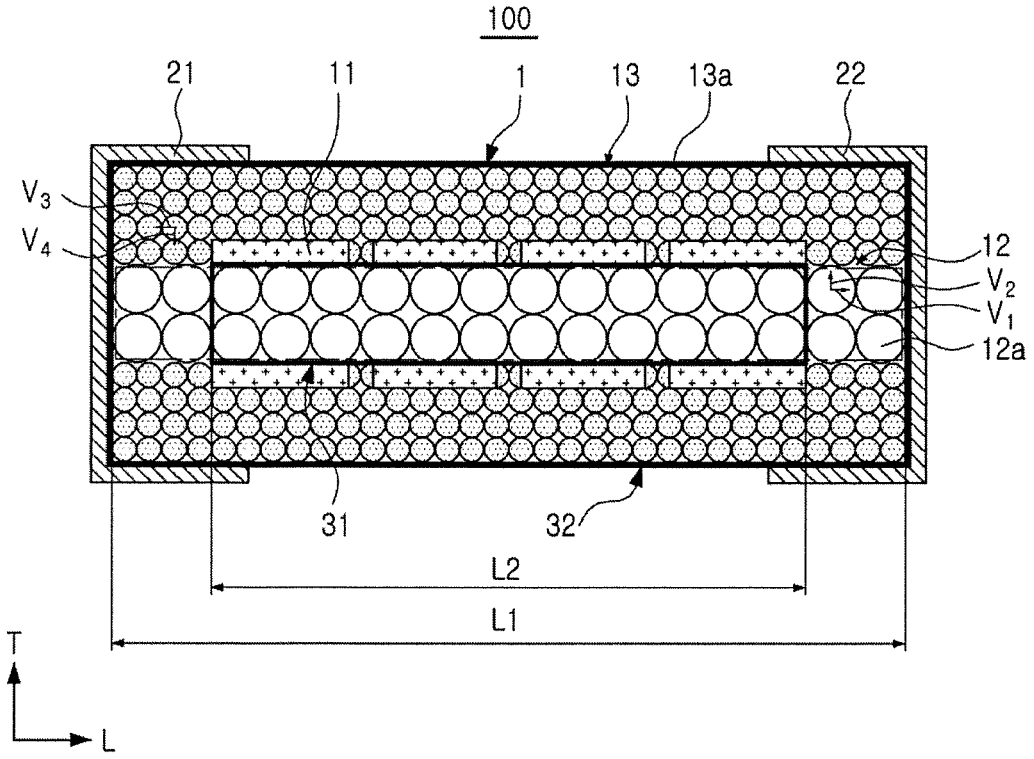
FIG. 1A shows a schematic cross-sectional view illustrating a coil component according to an exemplary embodiment in the present disclosure.

FIG. 1A shows a schematic cross-sectional view illustrating a coil component 100 according to an exemplary embodiment in the present disclosure.

Referring to FIG. 1A, the coil component 100 may include a body 1 and first and second external electrodes 21 and 22 disposed on an external surface of the body.

Figure 1B:
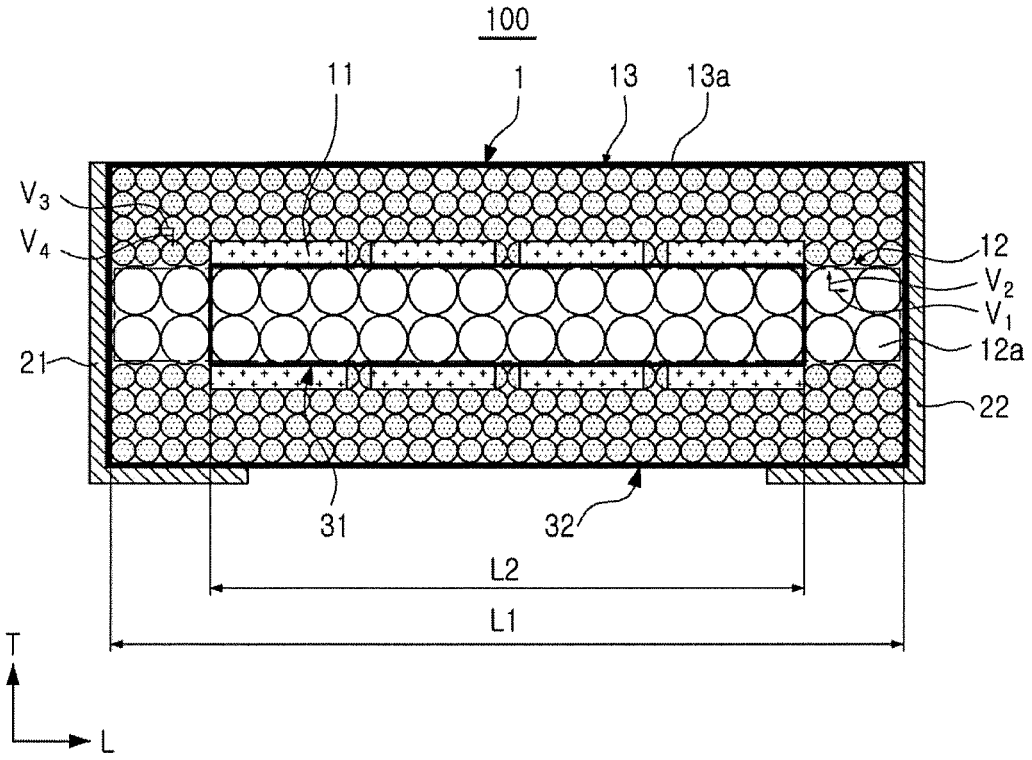
FIG. 1B shows a schematic cross-sectional view illustrating a coil component according to another exemplary embodiment in the present disclosure.

Although a case in which a structure of the first and second external electrodes 21 and 22 has an alphabet C shape is illustrated in FIG. 1A, the structure of the first and second external electrodes 21 and 22 is not limited thereto. That is, the structure of the first and second external electrodes 21 and 22 may also be changed so that the first and second external electrodes 21 and 22 are lower electrodes disposed only a mounting surface of the body or have an alphabet L shape (FIG. 1B).

The body 1 may have upper and lower surfaces opposing each other in a thickness (T) direction, first and second end surfaces opposing each other in a length (L) direction, and first and second side surfaces opposing each other in a width (W) direction, and be substantially hexahedron. However, an external shape of the body is not limited at all.

A winding coil 11 may be included in the body 1. Here, a winding method of the winding coil 11 is not limited. For example, the winding coil 11 may be wound by an alpha winding method, an edgewise winding method, or an array winding method.

Structurally, the winding coil 11 may be formed to be wound around a magnetic core 12 and embedded by an encapsulant 13. The magnetic core 12 may contain first magnetic particles 12*a* having shape-related magnetic anisotropy, and the encapsulant 13 may contain second magnetic particles 13*a* having shape-related magnetic anisotropy.

The first and second magnetic particles 12*a* and 13*a* may be particles formed to have the same composition and the same ingredient ratios as each other, but are not limited thereto. The first and second magnetic particles 12*a* and 13*a* may also be particles having different compositions and/or different ingredient ratios from each other.

The first and second magnetic particles 12*a* and 13*a* have shape-related magnetic anisotropy, which may mean that long axes of the first and second magnetic particles 12*a* and 13*a* may be distinguished from short axes thereof and thus a magnetic flux may be concentrated in a specific direction.

FIGS. 2A, 2B, 3A, and 3B illustrate shape-related magnetic anisotropy of a magnetic particle. A concept for long axes of the first and second magnetic particles 12*a* and 13*a* having shape-related magnetic anisotropy will be described in detail with reference to FIGS. 2A, 2B, 3A, and 3B. For convenience of explanation, the first magnetic particle 12*a* contained in the magnetic core 12 will be mainly described, but a content associated with the first magnetic particle may also be applied to the second magnetic particle 13*a* as it is.

Figure 2A:
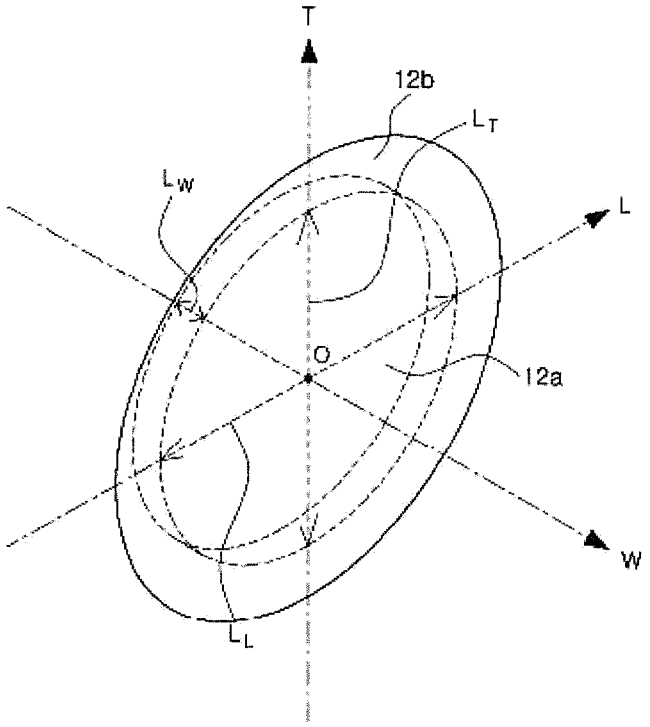
FIGS. 2A, 2B, 3A, and 3B show views illustrating shape-related magnetic anisotropy of a magnetic particle.
Figure 2B:
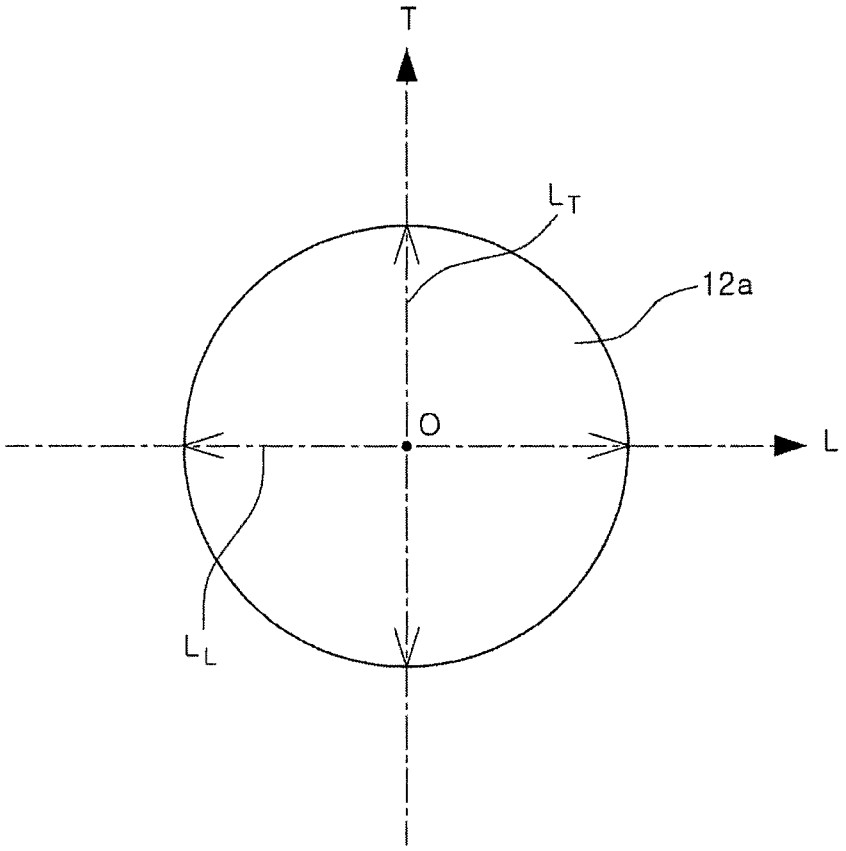

Referring to FIGS. 2A and 2B, the first magnetic particle 12*a* may have a plate shape and a cross section thereof may be round. In a case in which the cross section of the first magnetic particle 12*a* is round, when the center O of a flake corresponds to an intersection point of a T axis, an L axis, and a W axis, which are central axes of a three-dimensional structure, a maximum length $L_W$ of the first magnetic particle extended in a W axis direction is shortest, a maximum length $L_L$ of the first magnetic particle extended in an L axis direction and a maximum length $L_T$ of the first magnetic particle extended in a T axis direction may be substantially equal to each other, and each of $L_T$ and $L_L$ may be larger than the maximum length $L_W$ of the first magnetic particle extended in the W axis direction.

Therefore, the first magnetic particle 12*a* having the plate shape illustrated in FIGS. 2A and 2B may have a plurality of long axes, and it is clear that some of them may be formed to be parallel to each of the T axis and the L axis.

Figure 3A:
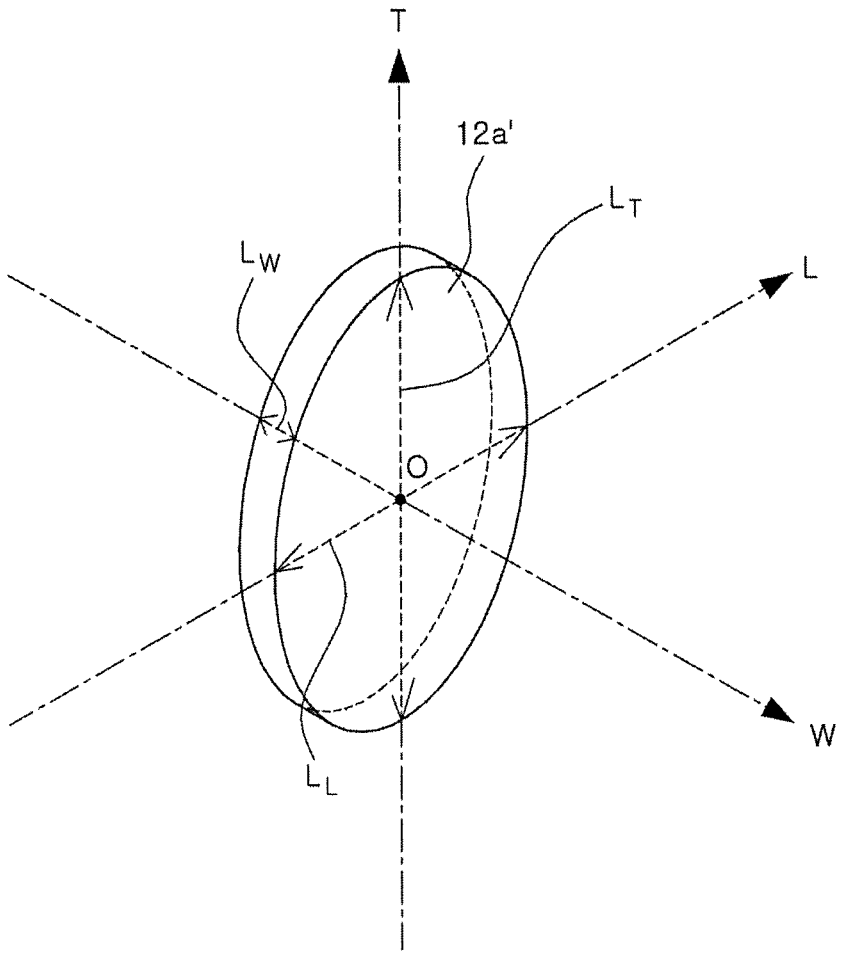
Figure 3B:
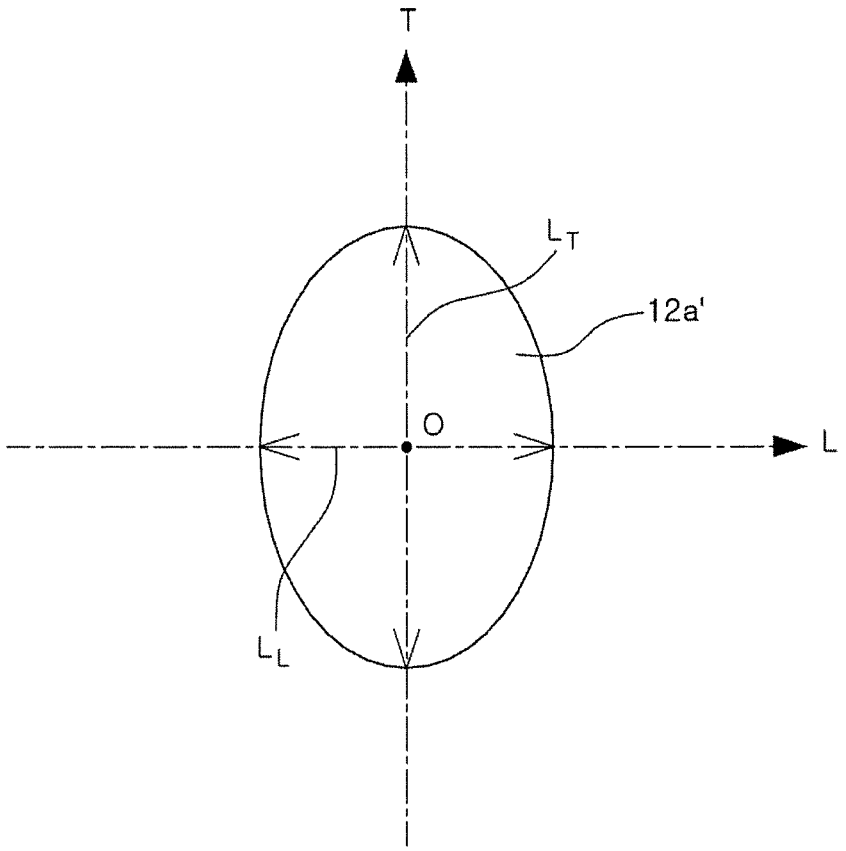

Next, FIGS. 3A and 3B illustrate a magnetic particle 12*a*' corresponding to a modified example of the first magnetic particle 12*a* illustrated in FIGS. 2A and 2B. A mixture of the first magnetic particle 12*a* of FIGS. 2A and 2B and the first magnetic particle 12*a*' of FIGS. 3A and 3B may be used. In addition, magnetic particles having shapes capable of allowing a magnetic flux generated from the coil and the long axis thereof to be parallel to each other in addition to the shapes illustrated in FIGS. 2A, 2B, 3A, and 3B may be used without limitations.

Referring to FIGS. 3A and 3B, a cross section of the first magnetic particle 12*a*' may be oval. In a case in which the cross section of the first magnetic particle is oval, when the center O of a flake corresponds to an intersection point of a T axis, an L axis, and a W axis, which are central axes of a three-dimensional structure, a maximum length $L_W$ of the first magnetic particle extended in a W axis direction is shortest, and a maximum length $L_L$ of the first magnetic particle extended in an L axis direction may be shorter than a maximum length $L_T$ of the first magnetic particle extended in a T axis direction, but larger than the maximum length $L_W$ of the first magnetic particle extended in the W axis direction. The maximum length $L_T$ of the first magnetic particle extended in the T axis direction may be longest.

Therefore, it may be appreciated that the first magnetic particle 12*a*' having a plate shape illustrated in FIGS. 3A and 3B may have one long axis, and be formed to be parallel to the T axis.

Therefore, regardless of a cross-sectional shape of the first magnetic particle 12*a*', when the first magnetic particle 12*a*' contained in the magnetic core according to the present disclosure is formed so that the maximum length $L_W$ thereof extended in the W axis direction is always shorter than the maximum lengths thereof extended in the L and T axis directions, the first magnetic particles 12*a*' may be arranged so as to concentrate the magnetic flux of the coil. In a case in which the first magnetic particle 12*a*' is disposed so that the long axis of the first magnetic particle 12*a*' is not parallel to the W axis, but is parallel to the T axis and/or the L axis, when a flow of the magnetic flux is formed alternately in the T axis direction and the L axis direction, the magnetic flux may be concentrated to the T axis or the L axis.

As illustrated in FIGS. 2A, 2B, 3A, and 3B, the first magnetic particle 12*a* or 12*a*' may have one or more long axes by changing an external shape of the particle, and the magnetic flux may be concentrated in one or more specific directions by using the property of the magnetic flux to be concentrated along the long axis. This may significantly increase permeability of the coil component 100.

Figure 5:
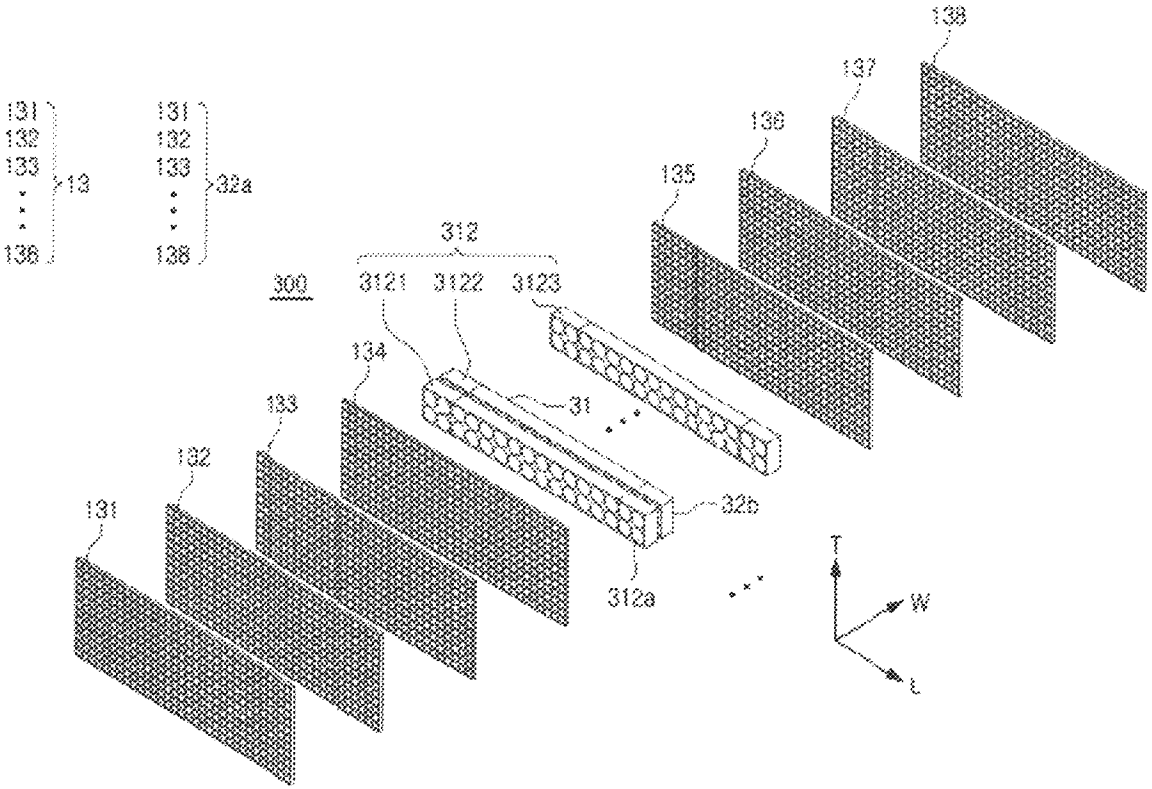
FIG. 5 shows a schematic exploded view illustrating another modified example of the coil component of FIG. 1A.

Referring to FIG. 1 again based on the description in FIGS. 2A, 2B, 3A, and 3B, the first magnetic particle 12 a contained in the magnetic core 12 may have two or more long axes, and among them, first and second long axes V1 and V2 may be perpendicular to each other. Since the first and second long axes V1 and V2 are perpendicular to each other, the magnetic core 12 may concentrate the magnetic flux generated by the coil 11 throughout a core central region 31 corresponding to an internal region of the coil 11 and an outer region 32 (or outer regions 32*a* and 32*b* as shown in FIG. 5) except for the core central portion.

Similarly, the second magnetic particle 13*a* contained in the encapsulant 13 may have two or more long axes, and among them, first and second long axes V3 and V4 may be perpendicular to each other. Since the first and second long axes V3 and V4 are perpendicular to each other, the encapsulant 13 may concentrate the magnetic flux generated by the coil 11 throughout regions at the sides of the coil 11 in addition to regions above and below the coil 11. Here, the regions above and below the coil 11 may mean regions of the encapsulant 13 positioned to be higher and lower than the coil 11 in the thickness (T) direction, respectively, and the regions at the sides of the coil 11 may mean regions of the encapsulant 13 positioned to be further extended in the length (L) direction and the width (W) direction than the coil 11.

Further, a length L1 of the magnetic core 12 extended in the length (L) direction may be longer than a length L2 of the winding coil 11 extended in the length (L) direction, such that both end surfaces of the magnetic core 12 may be exposed to external surfaces of the body 1. In this case, since the length L1 of the magnetic core 12 is longer than the length L2 of the winding coil 11, a direction of the magnetic flux generated by the winding coil 11 may be changed in the magnetic core 12. In the coil component 100, since a plurality of long axes are provided in the magnetic core 12, directions of the magnetic flux and the long axis of the magnetic particle e.g. 12*a* may be controlled to be parallel to each other in an outer portion of the winding coil 11 as well as an inside portion of the winding coil 11. As a result, permeability and inductance of the coil component 100 may be significantly improved.

Figure 4:
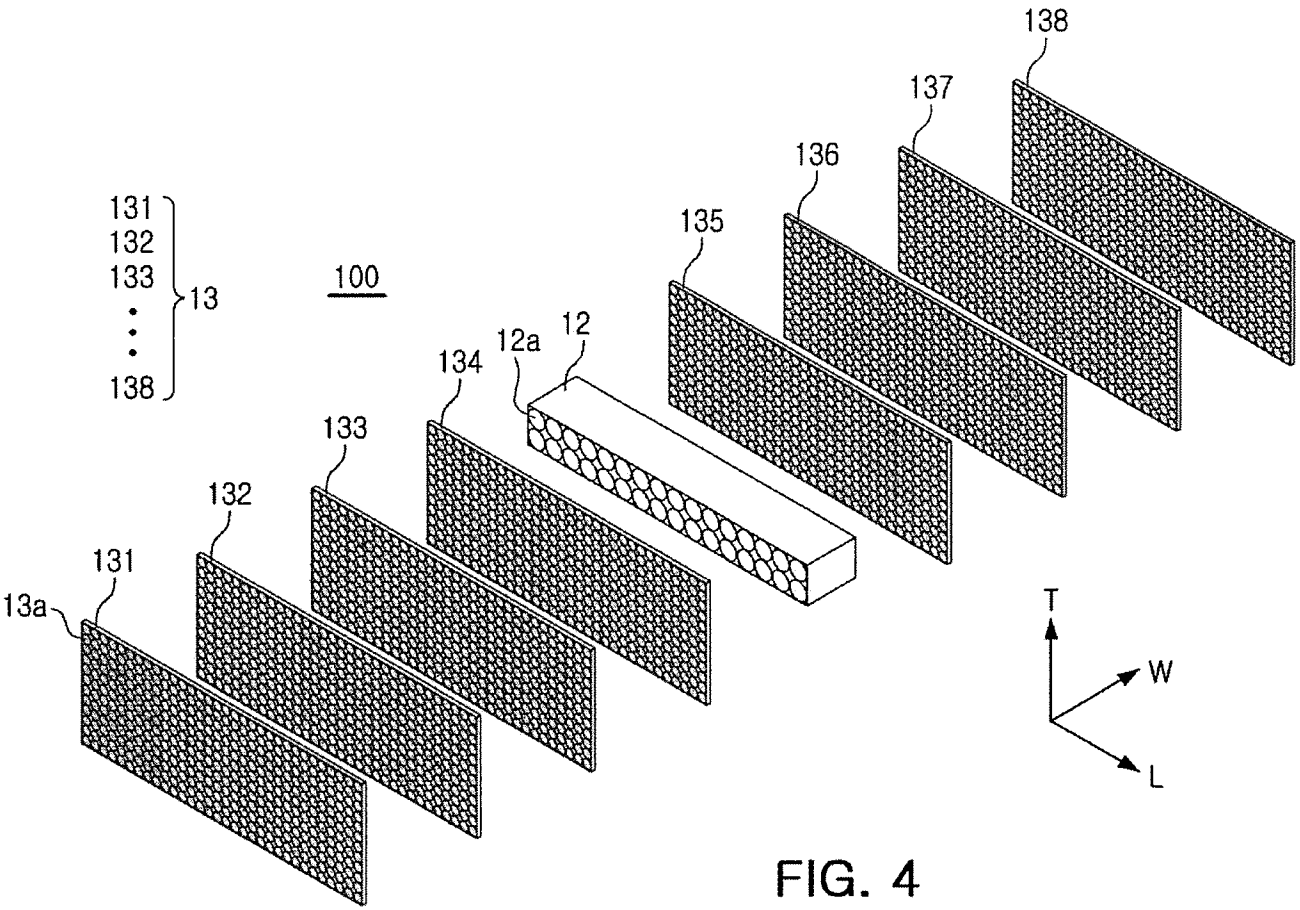
FIG. 4 shows a schematic exploded view illustrating an example of the coil component of FIG. 1A.

Next, FIG. 4 is a schematic exploded view of the coil component 100 of FIG. 1. The magnetic core 12 and the encapsulant 13 configuring the body 1 of FIG. 1 will be described in more detail with reference to FIG. 4.

In order to more effectively describe a structure of the body 1, the winding coil 11 wound around the magnetic core 12 is omitted in FIG. 4.

Referring to FIG. 4, the magnetic core 12 may be formed by filling the first magnetic particle 12*a* having shape-related magnetic anisotropy and a polymer in a mold prepared in advance and pressure-molding the first magnetic particle 12*a* and the polymer so that the long axis of the first magnetic particle 12*a* may be consistently arranged. Therefore, the magnetic core 12 may have an integrated structure containing the first magnetic particle 12*a* and the polymer. Further, a shape of an external surface of the magnetic core 12 may correspond to a shape of an inner boundary surface of the mold determining an external shape of the magnetic core 12. For example, a surface roughness of the external surface of the magnetic core 12 may be substantially equal to that of the inner boundary surface of the mold at a position corresponding thereto.

In FIG. 4, the magnetic core 12 has a rectangular parallelepiped shape, which means that a shape of a cavity of the mold used to form the magnetic core 12 has a rectangular parallelepiped shape. Although not illustrated, the magnetic core 12 may have a pillar shape with a central axis disposed to be parallel to the length (L) direction. For example, the magnetic core 12 may have a cylindrical shape.

Meanwhile, in the first magnetic particle 12*a* contained in the magnetic core 12, any material may be used without limitation as long as it contains at least one metal to have magnetic properties. For example, a Fe—Ni based permalloy, a Fe—Si—Al based sendust alloy, a Fe—Si based alloy, or the like, may be used. Further, a polymer 12*b* may be contained around the first magnetic particle 12*a*. That is, an epoxy resin 12*b* may be coated on a surface of the first magnetic particle 12*a*. In this case, the epoxy resin 12*b* to be coated may be directly disposed on the surface of the first magnetic particle 12*a* without a separate inorganic insulating layer. A structure in which the epoxy resin 12*b* is directly coated on the surface of the first magnetic particle 12*a* may be referred to as a core-shell structure, wherein a core may be formed of one or more of the above-mentioned alloys, and a shell may be formed of the epoxy resin.

Next, the encapsulant 13 encapsulating the winding coil 11 wound around the magnetic core 12 will be described. Referring to FIG. 4, the encapsulant 13 may have a stacked structure in which a plurality of magnetic sheets 131, 132, . . . , and 138 containing the second magnetic particle 13*a* are stacked. The magnetic sheet 131, 132, . . . , or 138 may be stacked so as to allow a stacking direction to be the width (W) direction. In this case, the short axis of the second magnetic particle 13*a* in the magnetic sheet 131, 132, . . . , or 138 may be extended in the width (W) direction.

The reason of stacking the magnetic sheets 131, 132, . . . , and 138 in the width (W) direction as the stacking direction in order to configure the encapsulant 13 is to allow the direction of the magnetic flux of the winding coil 11 encapsulated by the encapsulant 13 and the short axis of the second magnetic particle 13*a* contained in the magnetic sheet 131, 132, . . . , or 138 to be disposed perpendicularly to each other.

Meanwhile, each of the magnetic sheets 131, 132, . . . , or 138 in the encapsulant 13 may have a structure in which a plurality of second magnetic particles 13*a* are dispersed in a curable resin and adjacent second magnetic particles 13*a* come into contact with each other.

The number, a size, or the like, of magnetic sheets 131, 132, . . . , and 138 configuring the encapsulant 13 may be suitably selected in consideration of characteristic values to be required, for example, a size of the coil component 100, permeability, or the like. In addition, the curable resin in the magnetic sheet 131, 132, . . . , or 138 may be, for example, an epoxy resin, and the second magnetic particle 13*a* may be formed of a permalloy.

Next, FIG. 5 is a schematic exploded view illustrating a coil component 300 corresponding to a modified example of the coil component 100 of FIG. 1. The coil component 300 illustrated in FIG. 5 is different from the coil component 100 in that a magnetic core 312 does not have an integrated structure, but has a stacked structure. Therefore, hereinafter, a description of technical contents equally applied to the coil component 100 of FIG. 1 will be omitted, and the magnetic core 312 of FIG. 5 will be mainly described.

Similarly to FIG. 4, in order to more effectively describe a structure of a body 1, a winding coil 11 wound around a magnetic core 12 is omitted in FIG. 5.

Referring to FIG. 5, the magnetic core 312 may have the stacked structure instead of the integrated structure. The magnetic core 312 may have a stacked structure in which a plurality of magnetic sheets 3121, 3122, . . . containing first magnetic particles 312*a* are stacked in a width (W) direction. The first magnetic particle 312*a* may have a plurality of long axes, and each of the long exes thereof may be disposed to be parallel to a direction of a magnetic flux generated in the winding coil (not shown). On the contrary, the first magnetic particle 312*a* may have one short axis, and it is preferable that the short axis is disposed to be perpendicular to the direction of the magnetic flux generated in the winding coil (not shown). In this case, the short axis may be preferably disposed in the width (W) direction.

Meanwhile, since the magnetic core 312, although not specifically illustrated in FIG. 5, has the stacked structure, a step between magnetic sheets may be inevitably present on a boundary surface between the magnetic core 312 and the encapsulant adjacent thereto, which is the external surface of the magnetic core 312. The reason is that it is physically impossible to stack a plurality of magnetic sheets without steps.

The coil component 300 illustrated in FIG. 5 has the magnetic core 312 with a different structure from the coil component 100 illustrated in FIG. 1, but similarly to the coil component 100, the direction of the magnetic flux generated in a winding coil (not shown) and a direction of the long axis of the magnetic particle 312*a* in the body may be arranged to be parallel to each other throughout an entire region of the body, such that permeability may be significantly increased.

Figure 6:
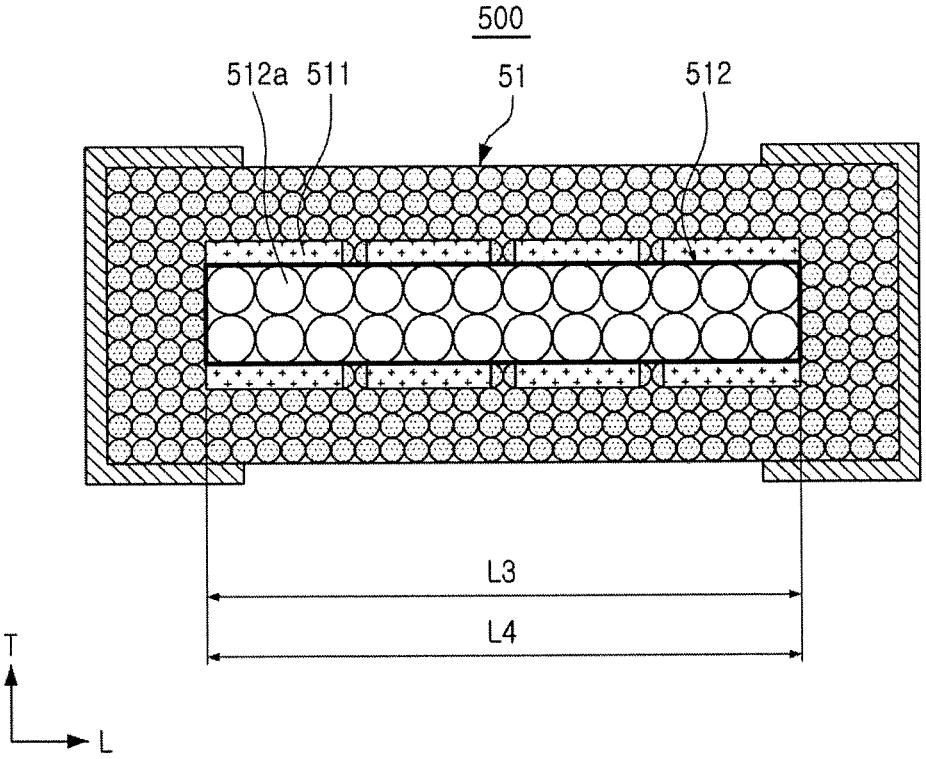
FIG. 6 shows a schematic cross-sectional view illustrating still another modified example of the coil component of FIG. 1A.

Next, FIG. 6 is a schematic cross-sectional view illustrating a coil component 500 corresponding to another modified example of the coil component 100 of FIG. 1. Even though the coil component 500 illustrated in FIG. 6 has a body 51 having an exterior shape substantially equal to that of the coil component 100 and has an integrated magnetic core 512 similar to the coil component 100 of FIG. 1, the coil component 500 has a different structure from that of the coil component 100 in that a length the magnetic core 512 extended in a length (L) direction is short. Therefore, hereinafter, a description of technical contents equally applied to the coil component 100 of FIG. 1 will be omitted, and the length of the magnetic core 512 of FIG. 6 and a shape of a first magnetic particle 512*a* capable of being changed depending on the length of the magnetic core 512 will be mainly described.

Referring to FIG. 6, the length L3 of the magnetic core 512 extended in the length (L) direction may be substantially equal to a length L4 of a winding coil 511 extended in the length (L) direction. This means that a core central portion defined as an internal region of the winding coil 511 coincides with the magnetic core 512. Since the magnetic core 512 needs only to be disposed in the core central portion of the winding coil 511, a long axis of a first magnetic particle 512*a* contained in the magnetic core 512 needs only to be parallel to a direction of a magnetic field in the winding coil 511. Therefore, the first magnetic particle 512*a* contained in the magnetic core 512 has a plurality of long axes, which is not essential, and the first magnetic particle 512*a* may have one long axis parallel with the direction of the magnetic field in the winding coil 511. For example, the first magnetic particle 512*a* may have a long ribbon shape in the length (L) direction.

Although the coil component 500 illustrated in FIG. 6 has a magnetic core 512 smaller than that in the coil component 100 illustrated in FIG. 1, but similar to the coil component 100, a direction of a magnetic flux generated in the winding coil 511 and a direction of the long axis of the magnetic particle 512*a* in the body 51 may be arranged to be parallel to each other throughout an entire region of the body 51, such that permeability may be significantly increased.

Figure 7:
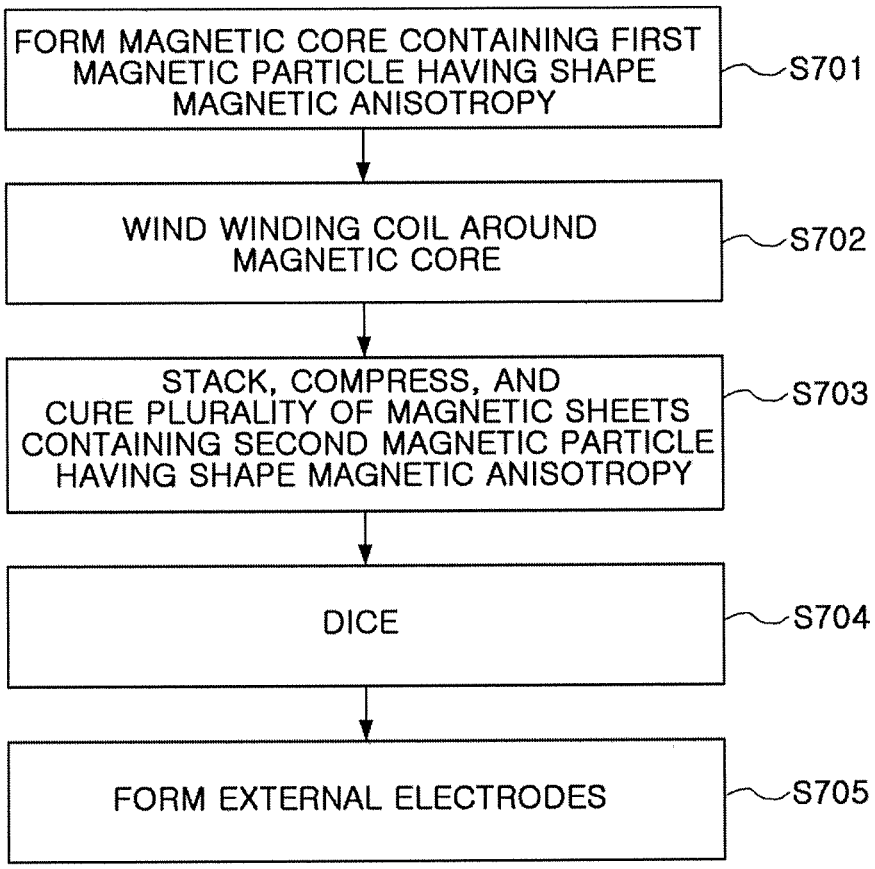
FIG. 7 shows a flowchart illustrating a schematic process of the coil component according to the exemplary embodiment in the present disclosure.

FIG. 7, which is a flowchart schematically illustrating a manufacturing process of the coil component according to the exemplary embodiment in the present disclosure, is not intended to limit a manufacturing method of the above-mentioned coil components 100, 300, and 500, but is provided by way of example among various manufacturing methods. Therefore, those skilled in the art may variously change the manufacturing method of the coil component in consideration of process conditions and environments.

First, in step S701, a magnetic core containing first magnetic particles having shape-related magnetic anisotropy may be formed. In the forming of the magnetic core, the first magnetic particles and a curable resin may be filled together in a mold, compressed at a molding pressure of about 1 to 2 ton/cm$^2$, and then cured, such that the magnetic core may be formed. Alternatively, a bar-shaped magnetic core may be manufactured by stacking, curing and dicing a plurality of magnetic sheets in which the first magnetic particles are dispersed in the curable resin. However, the forming of the magnetic core is not limited thereto.

Next, in step S702, the winding coil may be wound around the magnetic core at a predetermined number of turns. Here, a winding method may be suitably selected, and is not limited. However, in this case, there is a need to allow a direction in which the magnetic flux will be formed in the winding coil not to be arranged to be parallel to a direction of the short axis of the first magnetic particle in the magnetic core. When the magnetic flux and the short axis of the magnetic particle are arranged to be parallel to each other, it is impossible to concentrate the magnetic flux.

In step S703, after the magnetic core including the winding coil wound on the surface thereof is obtained, a plurality of magnetic sheets containing second magnetic particles having shape-related magnetic anisotropy may be stacked, compressed, and cured so as to encapsulate the magnetic core. Here, preferably, a direction in which the magnetic sheets are stacked may be set to be equal to a direction in which the short axis of the first magnetic particle in the magnetic core is arranged. Meanwhile, since the winding coil is in a state in which the winding coil is wound around the magnetic core of which the curing is completed in advance, even in a case of pressurizing the winding coil by stacking and compressing the magnetic sheets, etc, damage or deformation such as distortion of the coil may be significantly decreased.

Next, in step S704, as a general finishing process, lead portions of the winding coil embedded in the body may be exposed to the outside by dicing the body, and in step S705, external electrodes may be formed on surfaces of the lead portions to thereby be electrically connected thereto.

Except for the above-mentioned description, a description of features overlapping those of the coil component according to the exemplary embodiment in the present disclosure described above will be omitted.

As set forth above, according to exemplary embodiments in the present disclosure, the flake having shape-related magnetic anisotropy is applied as the magnetic particle, and the long axis of the flake is disposed to be parallel to the direction of the magnetic field of the coil throughout the entire region including a central portion of the coil and an outer portion of the coil, such that the coil component capable of securing structural reliability by significantly decreasing deformation of the coil while having improved permeability may be provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a winding coil; and external electrodes disposed on length-wise opposing external surfaces of the body, wherein the body includes a magnetic core wound with the winding coil in a thickness direction, and an encapsulant which encapsulates the winding coil, the magnetic core contains first magnetic particles having shape-related magnetic anisotropy, and the encapsulant contains second magnetic particles having shape-related magnetic anisotropy, the encapsulant has a stacked structure in which a plurality of magnetic sheets are stacked in a width direction, the plurality of magnetic sheets containing the second magnetic particles, long axes of the first and second magnetic particles are arranged to be parallel to a direction of a magnetic field formed in the winding coil, and the second magnetic particles have a short axis perpendicular to the magnetic field of the winding coil.

2. The coil component of claim 1, wherein the first and second magnetic particles have a plurality of long axes, respectively, and at least one of the plurality of long axes is perpendicular to another long axis thereof.

3. The coil component of claim 1, wherein the magnetic sheet of the encapsulant has a structure in which a plurality of second magnetic particles are dispersed in a curable resin, and adjacent second magnetic particles come into contact with each other.

4. The coil component of claim 1, wherein a length of the magnetic core extended in the direction of the magnetic field in the winding coil is longer than that of the winding coil extended in the direction of the magnetic field in the winding coil.

5. The coil component of claim 1, wherein both end surfaces of the magnetic core are exposed to the external surface of the body.

6. The coil component of claim 1, wherein the body is comprised of a core central portion defined as an internal region of the winding coil and an outer portion enclosing the core central portion, and the magnetic core forms the core central portion and at least a portion of the outer portion.

7. The coil component of claim 6, wherein at least one long axis of the first magnetic particle in the core central portion is perpendicular to at least one long axis of the first or second magnetic particle in the outer portion.

8. The coil component of claim 1, wherein the body has upper and lower surfaces opposing each other in the thickness direction, first and second end surfaces opposing each other in a length direction, and first and second side surfaces opposing each other in the width direction, the direction of the magnetic field in the winding coil is parallel to the length direction.

9. The coil component of claim 8, wherein the first magnetic particle in the magnetic core has one short axis, and the short axis is disposed to be parallel to the width direction.

10. The coil component of claim 8, wherein an outer boundary surface of the magnetic core has a surface roughness corresponding to that of an inner boundary surface of a mold used to form the magnetic core.

11. The coil component of claim 10, wherein the magnetic core has a pillar shape with an axis disposed to be parallel to the length direction.

12. The coil component of claim 10, wherein the first magnetic particle contained in the magnetic core has a core-shell structure, a core of the first magnetic particle contains a compound containing at least one metal, a shell thereof contains an epoxy resin, the core of the first magnetic particle is enclosed by the shell, and the shell is directly disposed on a surface of the core.

13. The coil component of claim 8, wherein the magnetic core has a stacked structure in which a plurality of magnetic sheets are layered in the width direction.

14. The coil component of claim 8, wherein the second magnetic particle in the encapsulant has one long axis, and a short axis is disposed to be parallel to the width direction.

15. The coil component of claim 1, wherein the first and second magnetic particles are flake particles or ribbon shaped particles.

16. The coil component of claim 1, wherein at least a portion of an external surface of the magnetic core comes in contact with an inner surface of the external electrode.

17. The coil component of claim 1, wherein each of the external electrodes has an alphabet C shape.

18. The coil component of claim 1, wherein each of the external electrodes has an alphabet L shape.

19. A coil component comprising:

a body including a winding coil, a plurality of stacked magnetic cores wound with the winding coil, and an encapsulant encapsulating the winding coil and the plurality of stacked magnetic cores; and external electrodes disposed on an external surface of the body, wherein the body has upper and lower surfaces opposing each other in the thickness direction, first and second end surfaces opposing each other in a length direction, and first and second side surfaces opposing each other in the width direction, the magnetic cores include first magnetic particles having shape-related magnetic anisotropy, the encapsulant includes second magnetic particles having shape-related magnetic anisotropy, the encapsulant has a stacked structure in which a plurality of magnetic sheets containing the second magnetic particles are stacked in the width direction, long axes of the first and second magnetic particles are arranged to be parallel to a direction of a magnetic field formed in the winding coil, the second magnetic particles have a first long axis and a second long axis perpendicular to the first long axis, and a short axis parallel to the width direction.

* * * * *